US009807482B2

(12) United States Patent
Vanderkley et al.

(10) Patent No.: US 9,807,482 B2
(45) Date of Patent: Oct. 31, 2017

(54) FLAT PANEL SPEAKER OR OTHER DEVICE MOUNT AND INSTALLATION METHOD

(71) Applicant: Amina Technologies Limited, Huntingdon, Cambridgeshire (GB)

(72) Inventors: Keith Vanderkley, Oshawa (CA); Egidijus Mikalauskas, Huntingdon (GB)

(73) Assignee: Amina Technologies Limited, Cambridgeshire (GB)

( * ) Notice: Subject to any disclaimer, the term of this patent is extended or adjusted under 35 U.S.C. 154(b) by 0 days.

(21) Appl. No.: 15/134,141

(22) Filed: Apr. 20, 2016

(65) Prior Publication Data

US 2016/0309247 A1 Oct. 20, 2016

(30) Foreign Application Priority Data

Apr. 20, 2015 (GB) ..... 1506659.0

(51) Int. Cl.
*H04R 1/02* (2006.01)
*H04R 7/04* (2006.01)

(52) U.S. Cl.
CPC ..... *H04R 1/025* (2013.01); *H04R 1/026* (2013.01); *H04R 7/04* (2013.01); *H04R 2201/021* (2013.01)

(58) Field of Classification Search
CPC ..... H04R 1/02
See application file for complete search history.

(56) References Cited

U.S. PATENT DOCUMENTS 4,179,009 A * 12/1979 Birkner ..... H04R 1/025 181/141
6,031,924 A 2/2000 Etzel
6,092,705 A * 7/2000 Meritt ..... B60R 11/02 224/275
9,271,584 B1 * 3/2016 Weinstein ..... A47F 5/135
2004/0245301 A1 * 12/2004 Truong ..... B60R 11/0229 224/275

(Continued)

FOREIGN PATENT DOCUMENTS

EP 2675185 12/2013

OTHER PUBLICATIONS

International Search Report for application No. GB1506659.0 dated Jul. 17, 2015.

*Primary Examiner* — Olisa Anwah
(74) *Attorney, Agent, or Firm* — Workman Nydegger

(57) ABSTRACT

A flat panel speaker comprises a mounting unit for mounting inside the surface and having a front and a back; a speaker unit having a flat panel, wherein the speaker unit is seated in the mounting unit and at least partially extending frontwardly from the front of the mounting unit; and at least one holding portion arranged for extending frontwardly outwards past the speaker unit and to be usable to hold the flat panel speaker in the surface during mounting. A method of mounting the flat panel speaker in a surface is also disclosed, comprising: inserting the mounting unit of the flat panel speaker through an opening defined in the surface; using the at least one holding portion to hold the flat panel speaker in the surface during mounting; and securing the mounting unit to the surface, whereby to hold the flat panel speaker in place in the surface.

19 Claims, 4 Drawing Sheets

(56) References Cited

U.S. PATENT DOCUMENTS

| | | | | |
|---|---|---|---|---|
| 2007/0064964 | A1* | 3/2007 | Cheung | H04R 7/04 381/323 |
| 2008/0010908 | A1* | 1/2008 | Mortier | H05K 5/0226 52/32 |
| 2008/0159582 | A1* | 7/2008 | Kawasaki-Hedges | H04R 5/02 381/388 |
| 2009/0249705 | A1 | 10/2009 | Struthers | |
| 2012/0145873 | A1* | 6/2012 | Wohlford | H04N 5/64 248/505 |
| 2013/0145581 | A1* | 6/2013 | Bailey | A45F 5/102 16/422 |
| 2015/0223352 | A1* | 8/2015 | Matsuda | A47B 95/02 361/679.01 |
| 2016/0157001 | A1* | 6/2016 | Manouel | H04R 1/025 381/332 |

* cited by examiner

FLAT PANEL SPEAKER OR OTHER DEVICE MOUNT AND INSTALLATION METHOD

CROSS-REFERENCE TO RELATED APPLICATIONS

The present invention claims the benefit of priority to Great Britain Patent Application No. GB1506659.0, filed Apr. 20, 2015, entitled "Flat Panel Speaker or Other Device Mount and Installation Method," the entire content of which is incorporated herein by reference.

BACKGROUND

1. The Field of the Invention

This invention relates to a mounting arrangement for a device, such as a flat panel speaker, to be mounted in a surface such as a wall so as to be flush or substantially flush with the surface. The invention relates, in particular, to a flat panel speaker mount.

It is often desirable to mount devices that would otherwise be taking up space within rooms in the walls or in other surfaces such as ceilings in those rooms so as to be flush with, or substantially not protruding from the surfaces.

For example, flat panel speakers such as distributed mode loudspeakers or balanced mode radiators provide an apparatus for producing sound which may be mounted flush to a surface of a wall or other structural element of a building, thereby avoiding space from being taken up within the room by a speaker system. To install these devices, typically, a housing or mounting unit is first installed in a hole formed in a wall. A flat panel speaker unit (or other device) is then fitted to the mounting unit after the mounting unit has been installed. This is a particularly elegant solution but there is an ongoing desire to ensure the quality, reliability and integrity of the installed device, and to facilitate the installation method. For example, flat panel speakers can provide high sound quality but this quality is only testable and verifiable only once the speaker unit is correctly fitted to the mounting unit inside the wall. This does not readily enable the assurance of reliable and repeatable performance.

It is in this context that the present invention is devised

BRIEF SUMMARY OF THE INVENTION

Viewed from one aspect, the present invention provides a flat panel speaker configured for mounting in a surface. The flat panel speaker comprises: a mounting unit such as a mounting box for mounting inside the surface, the mounting unit having a front and a back; a speaker unit having a flat panel, wherein the speaker unit is seated in the mounting unit and at least partially extending frontwardly from the front of the mounting unit; and at least one detachable handle affixed to the mounting unit or the speaker unit and arranged for extending frontwardly outwards past the speaker unit and to be usable to hold the flat panel speaker in the surface during mounting.

Thus, there is provided a holding portion, such as a handle, on a flat panel speaker which can be used when mounting the flat panel speaker to hold the flat panel speaker in position. The detachable handle affixed to the mounting unit or the speaker unit may be affixed to the mounting unit or the speaker unit prior to shipping. In an embodiment, at least a portion of the detachable handle may be removed from the respective mounting unit or speaker unit after mounting the flat panel speaker.

The handle may be affixed rearwardly of the flat panel and may extend past an outer boundary of the flat panel.

The handle may comprise a removable portion and a non-removable portion. The removable portion may be configured to be removable from the flat panel speaker. The non-removable portion may be configured to remain affixed to the flat panel speaker when the removable portion is removed.

The holding portion may be frangibly connected to the flat panel speaker.

The holding portion may be configured to be removable from the flat panel speaker by at least one of cutting, tearing, snapping or breaking.

The speaker unit may be arranged to be flush with the surface in use.

The holding portion may be attached to the flat panel speaker. The holding portion may be attached to the mounting unit.

The speaker unit may have a footprint smaller than the mounting box in at least one direction along the front of the mounting unit.

The holding portion may be a strap. The strap may be formed from fabric.

The mounting box may comprise at least two holding portions.

Viewed from another aspect, the present invention provides a method of mounting a flat panel speaker in a surface. The flat panel speaker comprises: a mounting unit such as a mounting box for mounting inside the surface and having a front and a back; a speaker unit having a flat panel, wherein the speaker unit is seated in the mounting unit and at least partially extending frontwardly from the front of the mounting unit; and at least one detachable handle affixed to the mounting unit or the speaker unit and arranged for extending frontwardly outwards past the speaker unit and to be usable to hold the flat panel speaker in the surface during mounting. The method comprises: inserting the mounting unit of the flat panel speaker through an opening defined in the surface; using the at least one handle to hold the flat panel speaker in the surface during mounting; and securing the mounting unit to the surface, whereby to hold the flat panel speaker in place in the surface.

Thus, the holding portion can be used to hold the flat panel speaker in place in the surface during mounting.

The method may further comprise removing the holding portion from the flat panel speaker.

The handle may be affixed rearwardly of the flat panel and may extend past an outer boundary of the flat panel.

The handle may comprise a removable portion and a non-removable portion. The removable portion may be configured to be removable from the flat panel speaker. The non-removable portion may be configured to remain affixed to the flat panel speaker when the removable portion is removed.

Removing the holding portion may be achieved by at least one of cutting, tearing, snapping or breaking. The at least one of cutting, tearing snapping or breaking the handle may occur at a position rearward of the flat panel.

The opening may be substantially the same size as a footprint of a speaker unit of the flat panel speaker. The footprint may be in a plane across a front of a mounting unit of the flat panel speaker from which the speaker unit at least partially extends frontwardly. The footprint may be smaller than the mounting unit in at least one direction along the front of the mounting unit.

The flat panel speaker may comprise at least two holding portions. The method may further comprise removing each of the at least two holding portions from the flat panel speaker by at least one of cutting, tearing, snapping or breaking.

The opening may be defined by at least one cut through the surface.

After the mounting box has been secured to the surface, the speaker unit may be arranged to be flush with the surface.

In accordance with the present invention, a flat panel speaker is provided that is preassembled inside a mounting box and that is provided with removable holding portions that enable the retrofitting of the flat panel speaker through a hole inside a wall or other surface. This simplifies the fitting process as only a single part needs to be installed. This is easily achieved through the holding portion(s) provided on the flat panel speaker. The installer can simply insert the speaker into the cavity in the wall through the hole, and hold the speaker in position using the holding portion(s) while fixing the speaker in place using, for example, screw fixings through the wall or plasterboard. After installation, the holding portions can be removed and discarded and the speaker can be finished by applying a skim or jointing tape to render it invisible.

As the speaker unit and mounting unit are pre-assembled, the mounting unit can provide protection for the rear of the speaker unit, and so the speaker unit no longer needs to be provided with a heavy protective casing on its rear surface and its construction can be simplified. In addition, the combination of the mounting unit and speaker unit as a pre-assembled component means that the flat panel speaker can be tested and quality controlled before shipping to allow an assurance of correct installation and operation. Further, the operating parts to the rear of the speaker unit are better isolated from contaminant dust and other damaging materials to which the device is exposed during installation, allowing a greater assurance of reliable and repeatable quality and performance.

Although the present invention has been described in relation to a flat panel speaker, it will be appreciated that the invention extends to any device mountable in a surface, particularly where the device is to be seated in an opening in the surface, to pass close to the edge of the opening, and particularly where the device is to be substantially flush with the surface. For example, from another aspect, the present invention provides a surface-mountable device configured for mounting in a surface. The surface-mountable device comprises a mounting unit such as a mounting box having a front and a back; a device unit at least partially extending from the front of the mounting unit and having a footprint smaller than the mounting unit in at least one direction along the front of the mounting unit; and at least one handle arranged for extending frontwardly outwards past the device unit. The device unit may be a control panel, for example a switch or a plurality of switches. The device unit may be a display panel, for example an electronic display panel.

Viewed from another aspect, the present invention provides a method of mounting a surface-mountable device in a surface. The flat surface-mountable device comprises: a mounting unit such as a mounting box for mounting inside the surface and having a front and a back; a device unit seated in the mounting unit and at least partially extending frontwardly from the front of the mounting unit; and at least one holding portion arranged for extending frontwardly outwards past the device unit and to be usable to hold the surface-mountable device in the surface during mounting. The method comprises: inserting the mounting unit through an opening defined in the surface; using the at least one holding portion to hold the surface-mountable device in the surface during mounting; and securing the mounting unit to the surface, whereby to hold the flat panel speaker in place in the surface.

Furthermore, although the presently described embodiments use at least one handle to be used to hold the flat panel speaker in position against in the surface, it will be appreciated that alternative embodiments are possible where at least one tab is arranged for extending frontwardly outwards past the speaker unit. In this embodiment, the tab may be configured to engage with a further device, wherein the tab and further device, when engaged, form a handle. After the flat panel speaker has been installed, the tab may be removed from the flat panel speaker. In some embodiments, the further device is disengaged from the tab, and the tab is withdrawn back into the flat panel speaker.

BRIEF DESCRIPTION OF THE DRAWINGS

Embodiments of the invention are further described hereinafter with reference to the accompanying drawings, in which.

DETAILED DESCRIPTION OF THE PREFERRED EMBODIMENTS

Figure 1:
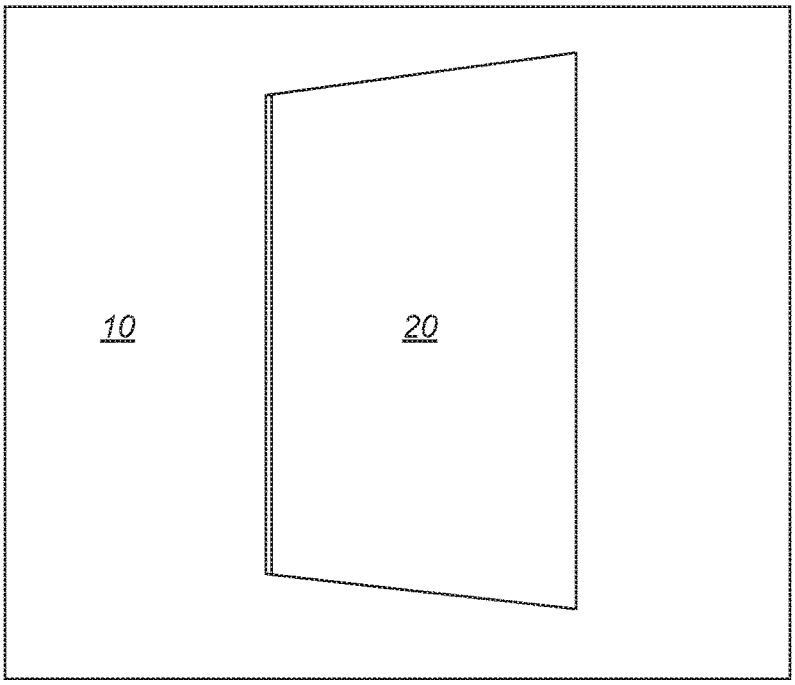
FIG. 1 is an illustration of an opening defined in a surface as used for an installation of an embodiment of a flat panel speaker in accordance with the present disclosure.

FIG. 1 is an illustration of an opening defined in a surface as used for an installation of an embodiment of a flat panel speaker in accordance with the present disclosure. In particular, a surface 10 has defined therein an opening 20. The surface 10 is the front surface of a plasterboard layer of a substantially vertical wall. The opening 20 is defined in the surface 10 by a series of cuts, resulting in a substantially rectangular opening 20 within the surface 10. The opening 20 has a horizontal extent of 40 centimeters and a vertical extent of 60 centimeters.

Although embodiments have described the surface 10 as a plasterboard layer of a substantially vertical wall, in one embodiment, the surface 10 is the whole thickness of the wall. The surface 10 can alternatively be a substantially horizontal surface such as a table or floor or ceiling. In one embodiment, the surface 10 is a layer of a ceiling, for example a ceiling tile. Although embodiments have described the opening 20 as being defined by a series of cuts, the opening 20 can alternatively be defined by the edges of the surface 10. Similarly, although embodiments have described the opening 20 as rectangular, it will be appreciated that alternative shapes may be used as required to fit with the shape of the flat panel speaker.

Figure 2:
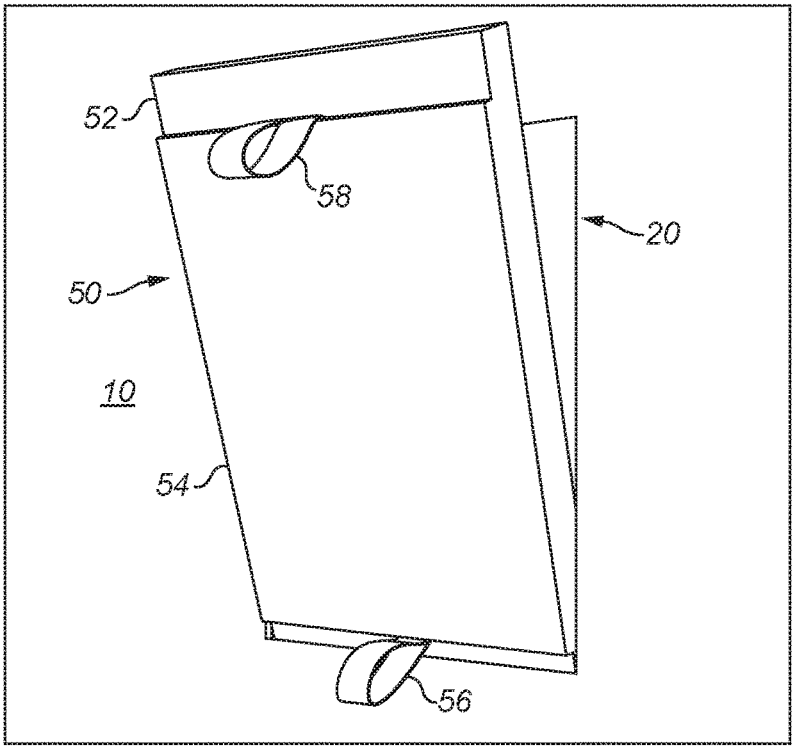
FIG. 2 is an illustration of an installation of an embodiment of a flat panel speaker in accordance with one embodiment of the present disclosure.

FIG. 2 is an illustration of an installation of an embodiment of a flat panel speaker in accordance with the present disclosure. A flat panel speaker 50 comprises a mounting unit in the form of a backing box 52. The backing box 52 is connected to a speaker unit 54 which is inserted in and retained by the backing box 52. The speaker unit 54 extends outwardly from a front of the backing box 52. The backing box 52 protects a back surface of the speaker unit 54. The speaker unit 54 is seated in the backing box 52. The backing box 52 has a footprint which is larger than the speaker unit 54 in one direction. The backing box 52 is typically formed from metal.

Figure 7:
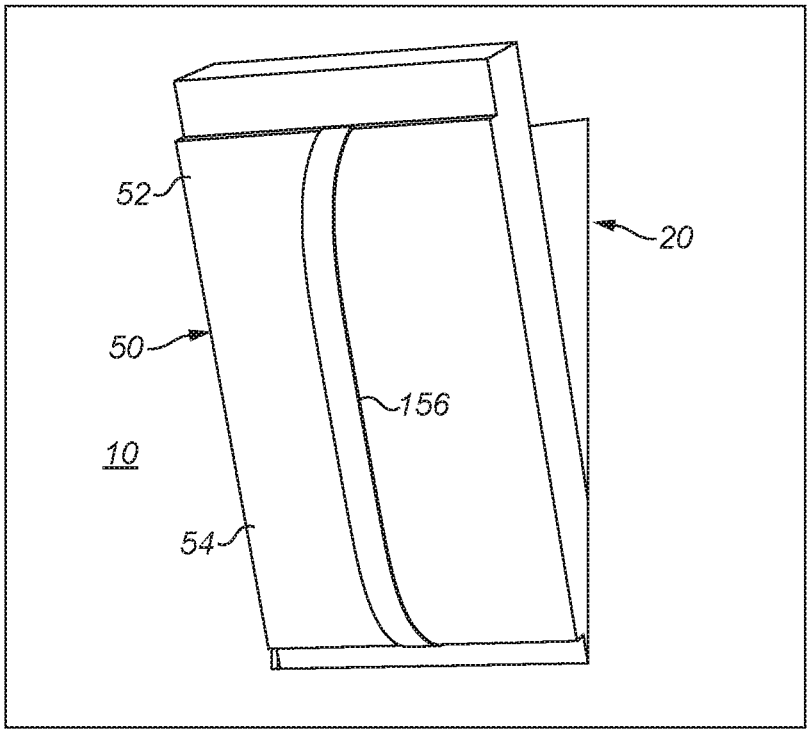
FIG. 7 is an illustration of an installation of another embodiment of a flat panel speaker in accordance with the present disclosure.

The speaker unit 54 comprises a flat panel and operates as a distributed mode loudspeaker. The speaker unit 54 is configured to generate sound when vibration modes are induced in the flat panel by an exciter (not shown). Two holding portions are provided on the flat panel speaker 50 in the form of a lower loop strap 56 and an upper loop strap 58. Each of the lower loop strap 56 and the upper loop strap 58 is attached to the backing box 52. The lower loop strap 56 extends past a bottom edge of the speaker unit 54. The upper loop strap 58 extends past a top edge of the speaker unit 54. The lower loop strap 56 and the upper loop strap 58 are formed from fabric to ensure they are flexible and are arranged to be able to withstand forces due to the weight of the flat panel speaker and the pulling of the flat panel speaker against the rear of the surface of the wall during mounting. In an alternative embodiment as shown in FIG. 7, a single holding portion 156 may be provided as a fabric strap or webbing attached to the backing box and extending from the top to the bottom of the flat panel speaker.

The opening 20 is dimensioned to substantially correspond to the dimensions of the panel of the speaker unit 54. The backing box 52 is dimensioned to be larger than the opening 54 in an axis of the backing box extending in the plane of the mounting surface to enable mounting of the backing box to the rear of the surface, for example by using screw fixings, but is otherwise dimensioned to enable the speaker unit to be passed through the hole into the surface by canting (e.g. by the backing box 52 and speaker unit 50 as a whole being marginally smaller than the opening in another axial direction of the plane of the opening 20).

The or each holding portion is configured to extend through the hole to allow the pre-assembled speaker 50 to be passed through the opening 20 and held in place flush with the surface 10 of the wall, despite there being only a small gap between the wall 10 in the opening 20 thereof and the edge of the panel of the speaker unit 54.

As can be seen in FIG. 2, a first stage of installing the flat panel speaker 50 in an opening 20 defined in a surface 10 is to pass a region of the backing box 52 in the vicinity of the lower loop strap 56 through a lower portion of the opening 20. The height of the backing box 52 is greater than the height of the opening 20. In order for the backing box 52 to be entirely passed through the opening 20, it will be appreciated that the backing box 52 must be passed through the opening 20 at an angle and canted into position.

Figure 3:
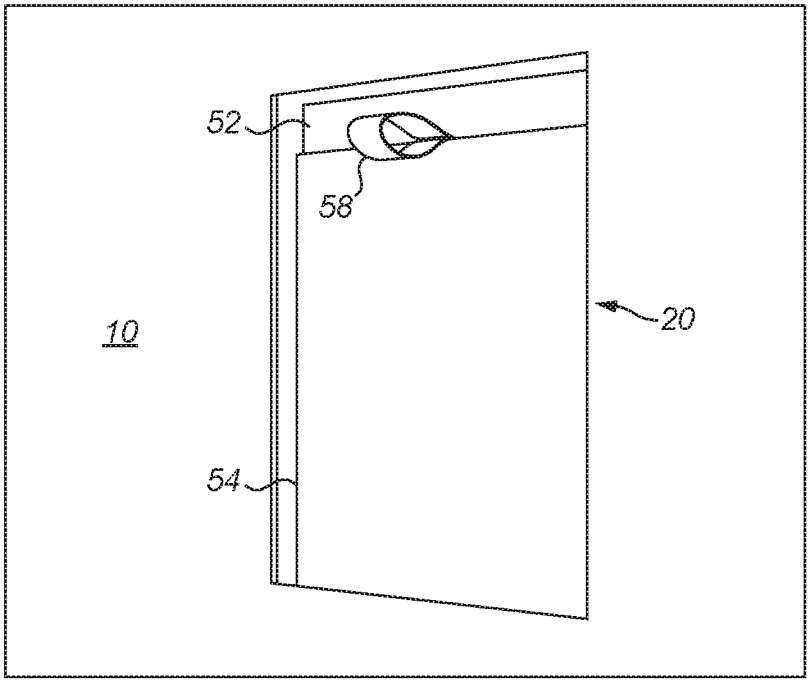
FIG. 3 is a further illustration of the installation of the flat panel speaker shown in FIG. 2.

FIG. 3 is a further illustration of the installation of the flat panel speaker shown in FIG. 2. As can be seen in FIG. 3, a second stage of installing the flat panel speaker 50 in an opening 20 defined in a surface 10 is to move the backing box 52 vertically downwards, such that a region of the backing box 52 in the vicinity of the upper loop strap 58 can pass through an upper portion of the opening 20. An installing user can hold the upper loop strap 58 and the lower loop strap 56 during this process to ensure that the flat panel speaker 50 can be correctly maneuvered in the opening 20. The upper loop strap 58 and the lower loop strap 56 can also be held to keep the flat panel speaker 50 from falling down behind the surface 10.

Figure 4:
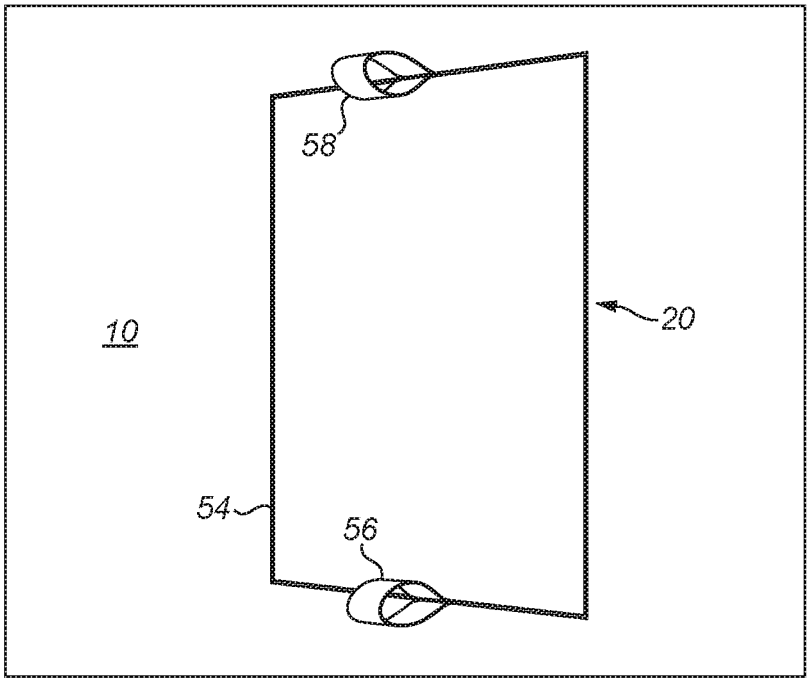
FIG. 4 is another illustration of the installation of the flat panel speaker shown in FIGS. 2 and 3.

FIG. 4 is another illustration of the installation of the flat panel speaker shown in FIGS. 2 and 3. Once the flat panel speaker 50 has been fully passed through the opening 20 as shown in FIG. 3, the installing user can use one or both of the upper loop strap 58 and the lower loop strap 56 to hold the flat panel speaker 50 in place in the opening 20 as shown in FIG. 4. In particular, a contacting surface of the backing box 52 (not visible in FIG. 4) is held against a back surface of the plasterboard layer (opposite the surface 10). The installing user uses the upper loop strap 58 and the lower loop strap 56 to hold the flat panel speaker in place in the opening 20 without having to touch the speaker unit 54, which may be delicate. The speaker unit 54 protrudes from the backing box 52 such that, in position, a front surface of the speaker unit 54 is substantially flush with the surface 10. Only a small gap is provided between the speaker unit 54 and the surface 10, such that the speaker unit can be inserted into the opening 20, and the upper loop strap 58 and the lower loop strap 56 can pass through the opening 20 between the surface 10 and the speaker unit 54.

Figure 5:
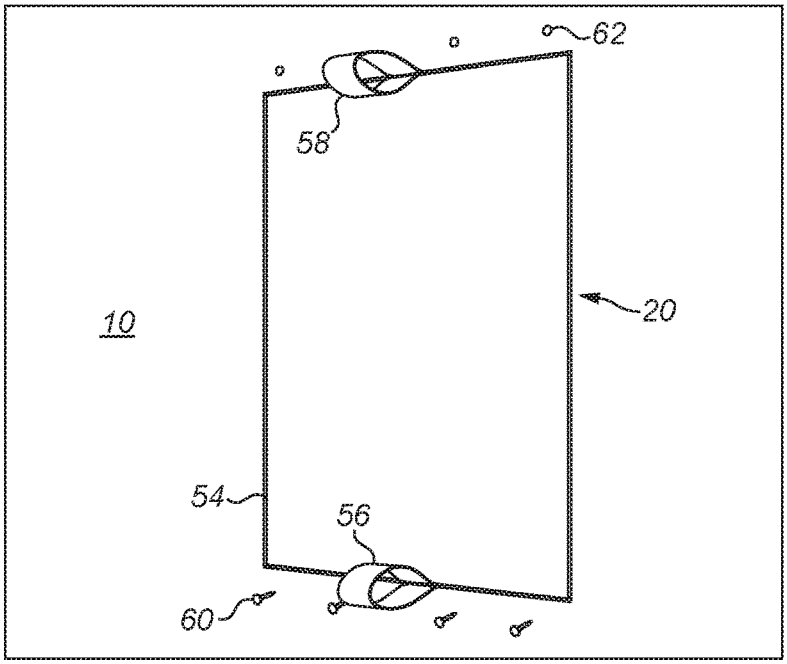
FIG. 5 is yet another illustration of the installation of the flat panel speaker shown in FIGS. 2 to 4.

FIG. 5 is yet another illustration of the installation of the flat panel speaker shown in FIGS. 2 to 4. Whilst the installing user continues to hold the flat panel speaker 50 in place in the opening 20, the same installing user or a further installing user can secure the flat panel speaker 50 in place in the surface 10. A series of mounting holes 62 are provided in the surface 10 above and below the opening 20, formed, for example, by drilling. The mounting holes 62 are positioned within the footprint of the backing box 52. In this way, a corresponding series of mounting screws 60 can pass through the mounting holes 62 of the surface 10 and engage with corresponding holes (not shown) in the backing box 52 to fixedly secure the speaker unit 50 in the opening 20. A head portion of each of the mounting screws 60 is configured to be countersunk in the surface so as to not to pass entirely through the mounting holes 62 in order to allow the head portion of the mounting screws 60 to be retained within the plasterboard layer.

Although the presently described embodiment has used mounting holes 62 and mounting screws 60 to secure the flat panel speaker 50 to the surface 10, it will be appreciated that alternative securing techniques will be apparent to the person skilled in the art and can be used. For example, one or both of the upper surface of the backing box 52 and the back surface of the plasterboard layer could have one or more adhesive regions to hold the flat panel speaker 50 in place in the opening 20.

Figure 6:
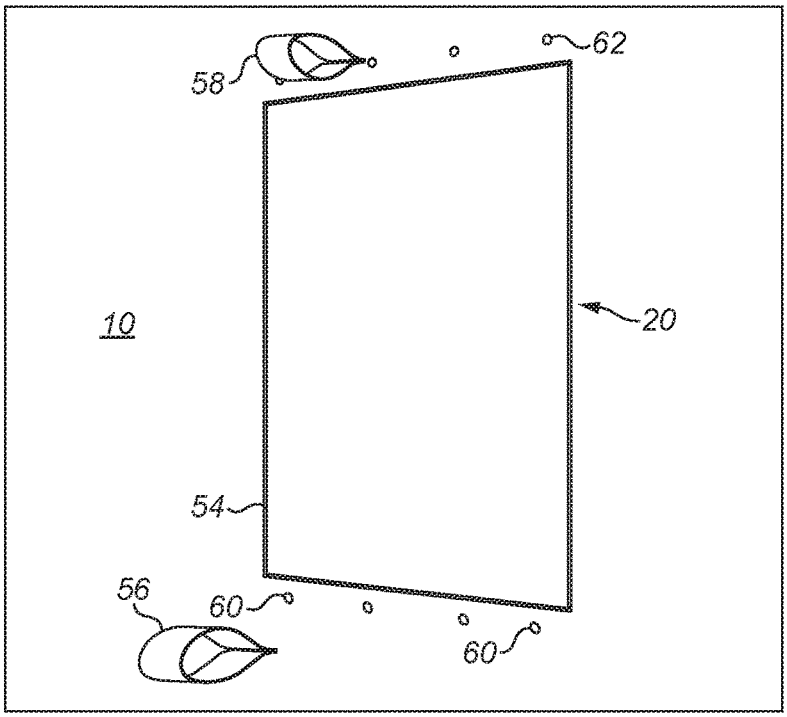
FIG. 6 is a yet further illustration of the installation of the flat panel speaker shown in FIGS. 2 to 5.

FIG. 6 is a yet further illustration of the installation of the flat panel speaker shown in FIGS. 2 to 5. After the flat panel speaker 50 has been fixedly secured in the opening 20, the installing user is no longer required to use the upper loop strap 58 or the lower loop strap 56 to hold the flat panel speaker 50 in place. In this particular embodiment, the upper loop strap 58 and the lower loop strap 56 are removed from the installed flat panel speaker 50 by cutting or tearing. For example, a knife (not shown) is used to cut the strap at or beneath the level of the opening 20, such that a stub of the upper loop strap 58 or the lower loop strap 56 does not protrude out of the opening 20. It will be appreciated that other ways of removing the upper loop strap 58 or the lower loop strap 56 can be used. For example, in some embodiments, one or both of the upper loop strap 58 and the lower loop strap 56 may be retractably attached to the backing box 52, such that the straps are configured to be pushed back through the opening so that the straps do not protrude out of the opening 20.

Once the flat panel speaker 50 is installed in the opening 20, any securing means such as mounting screws 60 and mounting holes 62 can be painted or plastered over. The gap between the surface 10 and the edge of the panel of the speaker unit 54 can be sealed, for example with jointing tape, and the whole surface can be finished with a skim plaster. The front surface of the speaker unit 54 can also be finished in substantially the same colour and texture as the surface 10. This ensures that the flat panel speaker 50 is substantially visually indistinguishable as a separate part of the surface 10, such that it is effectively 'invisible'.

Throughout the description and claims of this specification, the words "comprise" and "contain" and variations of them mean "including but not limited to", and they are not intended to (and do not) exclude other components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The disclosure extends to any novel one, or any novel combination, of the features disclosed in this specification (including any accompanying claims, abstract and drawings), or to any novel one, or any novel combination, of the steps of any method or process so disclosed.

We claim:

1. A flat panel speaker configured for mounting in a surface, comprising:
- a mounting unit for mounting inside the surface and having a front and a back;
- a speaker unit having a flat panel, wherein the speaker unit is seated in the mounting unit and at least partially extending frontwardly from the front of the mounting unit; and
- at least one detachable handle affixed to the mounting unit or the speaker unit and arranged for extending frontwardly outwards past the speaker unit and to be usable to hold the flat panel speaker in the surface during mounting;
- wherein the at least one detachable handle is affixed rearwardly of the flat panel and extends past an outer boundary of the flat panel.

2. The flat panel speaker as claimed in claim 1, wherein:
- the at least one detachable handle comprises a removable portion and a non-removable portion;
- the removable portion is configured to be removable from the flat panel speaker; and
- the non-removable portion is configured to remain affixed to the flat panel speaker when the removable portion is removed.

3. The flat panel speaker as claimed in claim 1, wherein the at least one detachable handle is configured to be removable from the flat panel speaker by at least one of cutting, tearing, snapping or breaking.

4. The flat panel speaker as claimed in claim 1, wherein the speaker unit is arranged to be flush with the surface in use.

5. The flat panel speaker as claimed in claim 1, wherein the at least one detachable handle is attached to the flat panel speaker.

6. The flat panel speaker as claimed in claim 5, wherein the at least one detachable handle is attached to the mounting unit.

7. The flat panel speaker as claimed in claim 1, wherein the speaker unit has a footprint smaller than the mounting unit in at least one direction along the front of the mounting unit.

8. The flat panel speaker as claimed in claim 1, wherein the at least one detachable handle is a strap.

9. The flat panel speaker as claimed in claim 8, wherein the strap is formed from fabric.

10. The flat panel speaker as claimed in claim 1, wherein the mounting unit comprises at least two handles.

11. A method of mounting a flat panel speaker in a surface, the flat panel speaker comprising:
- a mounting unit for mounting inside the surface and having a front and a back;
- a speaker unit having a flat panel, wherein the speaker unit is seated in the mounting unit and at least partially extending frontwardly from the front of the mounting unit; and
- at least one detachable handle affixed to the mounting unit or the speaker unit and arranged for extending frontwardly outwards past the speaker unit and to be usable to hold the flat panel speaker in the surface during mounting,
- and the method comprising:
- inserting the mounting unit of the flat panel speaker through an opening defined in the surface;
- using the at least one detachable handle to hold the flat panel speaker in the surface during mounting; and
- securing the mounting unit to the surface, whereby to hold the flat panel speaker in place in the surface;
- wherein the handle is affixed rearwardly of the flat panel and extends past an outer boundary of the flat panel.

12. The method as claimed in claim 11, further comprising removing the detachable handle from the flat panel speaker.

13. The method as claimed in claim 12, wherein:
- the at least one detachable handle comprises a removable portion and a non-removable portion;
- the removable portion is configured to be removable from the flat panel speaker; and
- the non-removable portion is configured to remain affixed to the flat panel speaker when the removable portion is removed.

14. The method as claimed in claim 12, wherein removing the at least one detachable handle is achieved by at least one of cutting, tearing, snapping or breaking.

15. The method as claimed in claim 14, wherein the at least one of cutting, tearing, snapping or breaking the handle occurs at a position rearward of the flat panel.

16. The method as claimed in claim 11, wherein:
- the opening is substantially the same size as a footprint of a speaker unit of the flat panel speaker;
- the footprint is in a plane across a front of a mounting unit of the flat panel speaker from which the speaker unit at least partially extends frontwardly; and
- the footprint is smaller than the mounting unit in at least one direction along the front of the mounting unit.

17. The method as claimed in claim 12, wherein the flat panel speaker comprises at least two handles, the method further comprising:

removing each of the at least two handles from the flat panel speaker by at least one of cutting, tearing, snapping or breaking.

18. The method as claimed in claim 11, wherein the opening is defined by at least one cut through the surface.

19. The method as claimed in claim 11, wherein after the mounting unit has been secured to the surface, the speaker unit is arranged to be flush with the surface.

* * * * *